US005285038A

United States Patent [19]

Asher et al.

[11] Patent Number: 5,285,038

[45] Date of Patent: Feb. 8, 1994

[54] LIGHTED MOMENTARY PUSH-BUTTON SWITCH ASSEMBLY HAVING INTEGRAL SWITCH ACTUATOR AND LAMP LOCATOR

[75] Inventors: Michael A. Asher, Camarillo, Calif.; Charles E. Kidwell, Kokomo; Robin L. Truesdell, Roseville, both of Ind.

[73] Assignee: Delco Electronics Corporation, Kokomo, Ind.

[21] Appl. No.: 6,357

[22] Filed: Jan. 19, 1993

[51] Int. Cl.[5] ..... H01H 9/18

[52] U.S. Cl. ..... 200/314

[58] Field of Search ..... 200/314

[56] References Cited

U.S. PATENT DOCUMENTS

| | | | |
|---|---|---|---|
| 3,979,571 | 9/1976 | Van Benschoten | 200/328 |
| 4,225,766 | 9/1980 | Pfeifer et al. | 200/314 |
| 4,317,968 | 3/1982 | Kuhfus | 200/5 R |
| 4,334,134 | 6/1982 | Janda | 200/314 |
| 4,360,722 | 11/1982 | Georgopulos | 200/314 |
| 4,408,109 | 10/1983 | Nat | 200/523 |
| 4,641,004 | 2/1987 | Keprda | 200/340 |
| 4,749,832 | 6/1988 | Schlosser | 200/314 |
| 4,920,243 | 4/1990 | Yuge | 200/314 |
| 4,931,607 | 6/1990 | Berger | 200/524 |
| 4,935,591 | 6/1990 | Kaneko | 200/293 |
| 5,032,698 | 7/1991 | Satoh | 200/341 |
| 5,059,754 | 10/1991 | Kaichi et al. | 200/332.1 |

FOREIGN PATENT DOCUMENTS

| | | | |
|---|---|---|---|
| 2085230 | 4/1982 | United Kingdom | 200/314 |

*Primary Examiner*—Renee S. Luebke

*Attorney, Agent, or Firm*—Mark A. Navarre

[57] ABSTRACT

A low part count momentary push-button assembly having an integral indicator lamp for indicating activation of a controlled circuit or device. The push-button assembly comprises a switch unit and indicator lamp mounted side-by-side on a central region of a printed circuit board, a push-button having a contact area disposed in axial alignment with the switch unit, and a light transmissive passage disposed in axial alignment with the indicator lamp, and a unitary interface element disposed intermediate the circuit board and the push-button. The interface element includes an integral sleeve for locating the indicator lamp in relation to the light transmissive passage of the push-button, and a cantilevered structure which is maintained in resilient engagement with the contact area of the push-button. The interface element snaps onto the circuit board, and the circuit board is snapped into a housing cavity. The push-button is retained in relation to the switch unit and indicator lamp by a housing element which closes the cavity.

3 Claims, 3 Drawing Sheets

LIGHTED MOMENTARY PUSH-BUTTON SWITCH ASSEMBLY HAVING INTEGRAL SWITCH ACTUATOR AND LAMP LOCATOR

This invention relates to a lighted momentary push-button switch assembly, and more particularly, to a switch assembly having a unitary interface disposed between the push-button and a switch element, which interface serves as a lamp locator and resilient actuator for the switch element.

BACKGROUND OF THE INVENTION

Momentary push-button switches are commonly used in automotive applications, for example, for the activation of a rear window de-fog or windshield de-ice timer circuit. In these and other applications, the provision of a lamp to indicate activation of the controlled circuit is usually desired. Also desired is a simplified assembly having a low part count for minimizing cost and time of installation.

SUMMARY OF THE PRESENT INVENTION

The present invention is directed to an improved, low part count, momentary push-button assembly having an integral indicator lamp for indicating activation of a controlled circuit or device.

The push-button assembly comprises a switch unit and indicator lamp mounted side-by-side on a central region of a printed circuit board, a push-button disposed in axial alignment with the switch unit and indicator lamp, and a unitary interface element disposed intermediate the circuit board and the push-button. The inboard face of the push-button includes a contact area disposed in axial alignment with the switch unit, and a light transmissive passage disposed in axial alignment with the indicator lamp. The interface element includes an integral sleeve for locating the indicator lamp in relation to the light transmissive passage of the push-button, and a cantilever arm which is maintained in resilient engagement with the contact area of the push-button. The interface element snaps onto the circuit board, and the circuit board is mounted in a housing cavity. The push-button is retained in relation to the remainder of the push-button assembly by a housing element which closes the cavity.

When the operator depresses the push-button, the cantilever arm is resiliently deflected to engage and actuate the switch unit. When the button is released, the cantilever arm returns the button to its rest position. In the illustrated embodiment, actuation of the switch unit activates a rear window de-fog timer circuit, which in turn, energizes the indicator lamp for the duration of the de-fog energization period.

The multi-functionality of the unitary interface element significantly reduces the part count and cost of the switch assembly and eases installation of the assembly into an instrument panel. In the preferred embodiment, the interface element is formed of plastic, using an injection molding process.

DETAILED DESCRIPTION OF THE INVENTION

Figure 1:
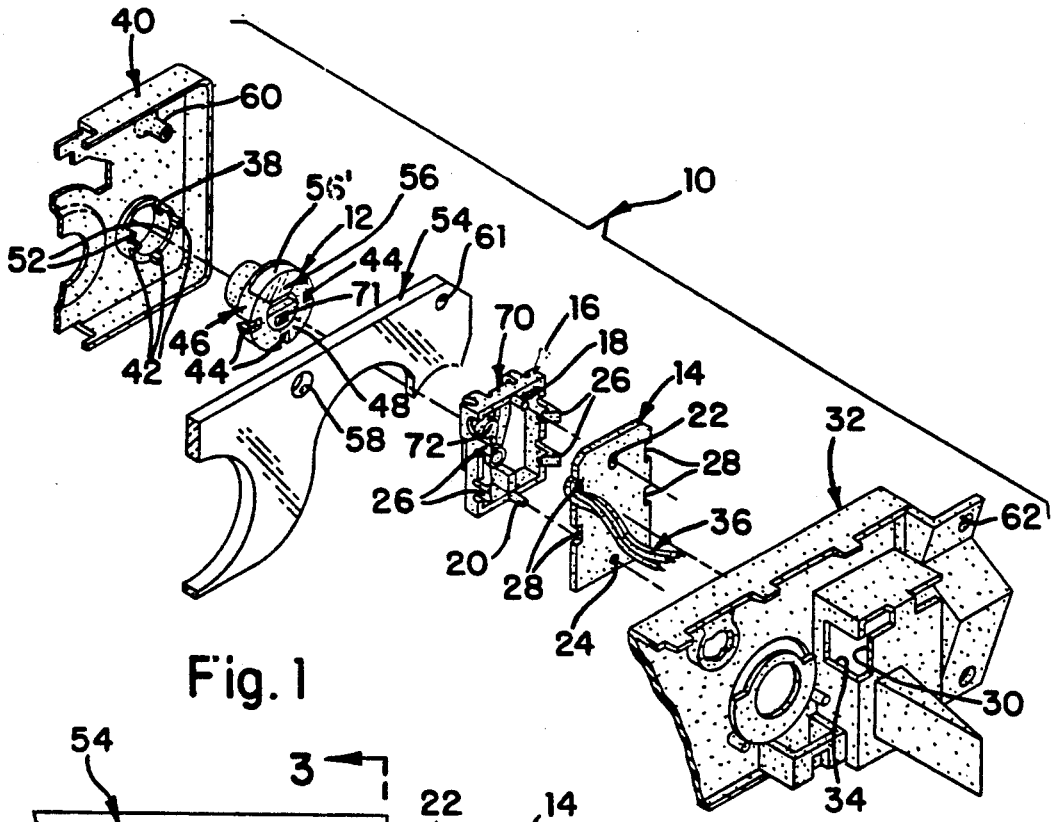
FIG. 1 is an exploded view of the push-button switch assembly of this invention, as installed in the instrument panel of a motor vehicle.

Referring to FIG. 1, the reference numeral 10 generally designates the constituent elements of a momentary push-button switch assembly according to this invention, and associated housing members of an automotive instrument panel. The push-button switch assembly alone comprises a push-button 12, a printed circuit board 14 and a plastic interface element 16 disposed between push-button 12 and printed circuit board 14.

The interface element 16 is oriented relative to the circuit board 14 by the posts 18 and 20 which are received in circuit board openings 22 and 24, respectively. Once properly oriented, the interface element 16 is secured to the circuit board 14 by a plurality of integral resilient fingers 26 which engage corresponding circuit board notches 28. This subassembly, in turn, is mounted in a recess or cavity 30 of instrument panel housing element 32. An opening 34 is provided in the housing element 32 to accommodate an electrical connector (not shown) for the circuit board lead-in wires 36. The push-button 12 partially extends through an opening 38 formed in the instrument panel face plate 40, the push-button 12 being rotationally captured due to the mating engagement of face plate tabs 42 with corresponding slots 44 formed in a push-button shoulder 46.

Upon assembly, the push-button 12 is axially retained at its inboard end through engagement of inboard face 48 with a resilient cantilevered rib 74, as described below in reference to FIGS. 3–4. At its outboard end, the push-button is axially retained through engagement of shoulder 46 with a surface 52 formed on the face plate tabs 42.

A light transmissive lightpipe 54 extends around the push-button assembly in proximity to a light transmissive portion 56 of push-button 12. The lightpipe 54 has one or more openings 58 for receiving a lamp (not shown), the lightpipe 54 acting to transmit light from the lamp to the light transmissive portion 56 of push-button 12. The entire assembly is retained in place by a plurality of fasteners (not shown) passing through axially aligned openings such as the openings 60, 61 and 62 in face plate 40, lightpipe 54 and housing member 32, respectively.

Figure 2:
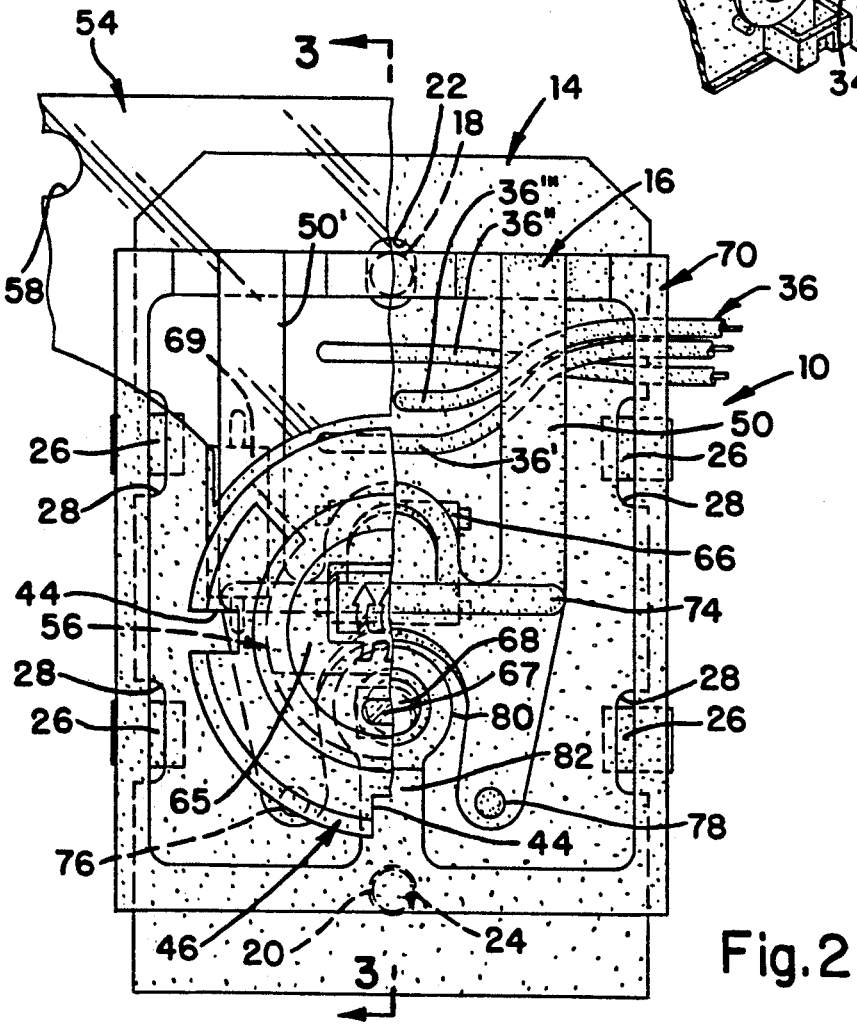
FIG. 2 is a partially broken away front view of the push-button assembly of this invention as installed in the motor vehicle instrument panel of FIG. 1.
Figure 3:
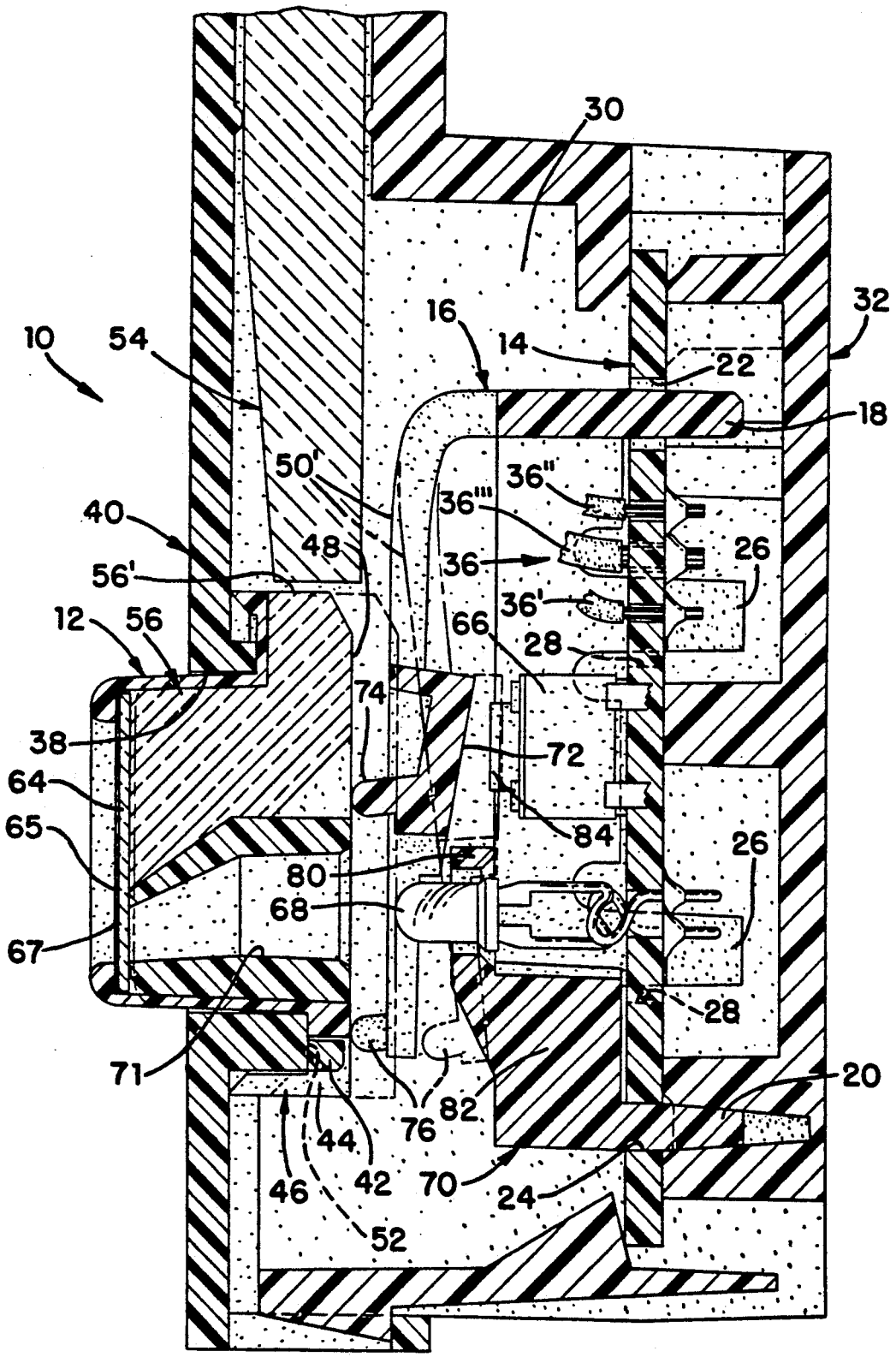
FIG. 3 is a sectional view of the push-button assembly, taken along the lines 3—3 of FIG. 2.

The circuit board 14, illustrated in section in FIG. 3, physically supports and electrically connects two essential elements: a miniature tactile switch 66, and a light emitting diode (LED) 68. The switch 66 is mounted in a central region of the circuit board 14 and the LED 68 is mounted adjacent the switch 66. In the illustrated embodiment, a current limiting resistor 69 is also mounted on the circuit board 14, as best seen in FIG. 2.

Electrically, LED 68 and resistor 69 are connected in series, the anode of LED 68 being connected to a positive voltage wire 36'''. The cathode of LED 68 is connected via resistor 69 to a control wire 36', and via the series combination of resistor 69 and switch 66 to a ground wire 36''. In operation, LED 68 is activated when switch 66 is depressed and thereafter, a timer circuit (not shown) continues the activation for a timed period by temporarily grounding the control wire 36'.

Figure 4:
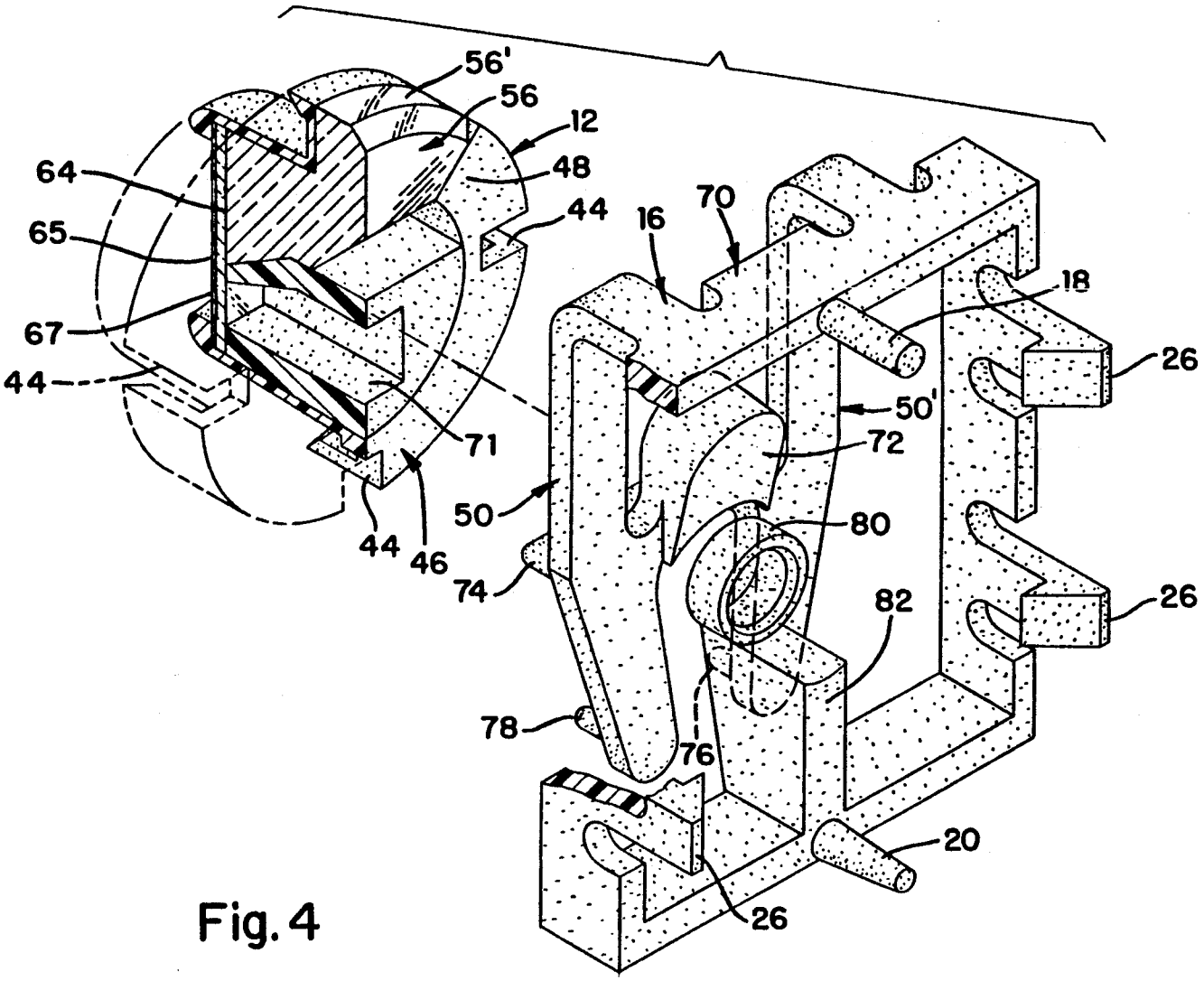
FIG. 4 is a partial exploded view detailing the push-button and the unitary interface element of the push-button assembly.

The interface member 16 and push-button 12 are illustrated in further detail in the exploded partial sectional view of FIG. 4. As shown, the push-button 12 includes a first light transmissive portion 56 having an exposed surface 56' for collecting light from lightpipe 54 to diffusely illuminate a central region of the transparent push-button cap 64. An applique 65 imprinted with a defog symbol (see FIG. 2) or the like covers the cap 64 so that the symbol is illuminated whenever the lightpipe lamps are illuminated.

A second light transmissive portion of push-button 12 is defined by an open passage 71. As shown, the passage 71 is optically isolated from the first light transmissive portion 56, and extends from the inboard face 48 of push-button 12 to the underside of cap 64. As seen in FIG. 2, the applique 65 is imprinted to define a light transmissive window 67 at the end of passage 71. The passage 71 is disposed in substantial axial alignment with LED 68 so that the window region 67 is brightly illuminated to indicate activation of the defog function when LED 68 is energized.

Referring again primarily to FIG. 4, the interface element 16 is a unitary injection molded structure comprising a box-like base 70 and a pair of substantially parallel cantilever arms 50 and 50' extending therefrom. The cantilever arms 50 and 50' are joined substantially at mid-length in proximity to switch 66 to define a first surface feature—laterally extending rib 74—for continuous engagement with the inboard face 48 of push-button 12 and a second surface feature—cleat 72—adapted to engage and displace a plunger 84 of switch 66 during depression of push-button 12. As best seen in FIGS. 2 and 3, the cleat 72 is axially aligned with tactile switch 66, and the rib 74 engages the inboard face 48 of push-button 12 to resiliently maintain push-button 12 in the normal, extended state. Post-like projections 76 and 78 formed on the ends of arms 50 and 50' also contact the inboard face 48 when push-button 12 is in the extended state, preventing the push-button 12 from rocking on rib 74.

The interface element 16 also includes an integrally formed sleeve 80 rigidly supported from the stationary base 70 on arm 82. The sleeve 80 has an inside diameter slightly larger than the outside diameter of LED 68, and as best seen in FIGS. 2 and 3, surrounds and supports LED 68 once the interface element 16 is affixed to circuit board 14. This serves to maintain LED 68 properly positioned, in substantial axial alignment with the passage 71 of push-button 12.

FIG. 3 illustrates both normal and actuated states of the push-button assembly 10, the activated state being shown in phantom. In the normal or rest state, the push-button 12 is maintained in a fully extended position due to its resilient engagement with cantilevered rib 74 and projections 76 and 78. Initial depression of the push-button 12 deflects the cantilever arms 50, 50' downward, bringing cleat 72 into engagement with the plunger 84 of tactile switch 66. Further depression of push-button 12 displaces the plunger 84, activating a defog or similar function. When push-button 12 is released, the cantilevered rib 74 and arms 50, 50' return it to a normal or rest state.

In the above-described manner, the unitary interface element 16 performs multiple switch functions, contributing to a low part count, cost effective and easy to assemble momentary push-button switch. The interface element 16 performs functions usually performed by multiple discrete parts, at a significantly higher cost. These functions include return spring force for push-button 12, actuation of the switch 66 and proper orientation of the LED 68 relative to push-button passage 71.

While this invention has been described in reference to the illustrated embodiment, it is nevertheless expected that various modifications will occur to those skilled in the art. In this regard, it should be understood that switch assemblies incorporating such modifications may fall within the scope of this invention which is defined by the appended claims.

The embodiments of the invention in which an exclusive property or privilege is claimed are defined as follows:

1. A momentary push-button switch assembly, comprising:

a circuit board, a switch unit mounted in a central region of said circuit board and an indicator lamp mounted on said circuit board adjacent said switch unit, said switch unit having a plunger displaceable to alter an electrical state of said switch unit;

a push-button having a contact area disposed in axial alignment with the plunger of said switch unit, and a light transmissive passage disposed in substantial axial alignment with said indicator lamp; and a unitary interface element disposed intermediate said circuit board and said push-button, said interface element including a sleeve having an inside diameter slightly larger than an outside diameter of said indicator lamp for surrounding and supporting said indicator lamp in relation to the light transmissive passage of said push-button, and cantilever means in resilient engagement with the contact area of said push-button, said cantilever means being deflectable upon depression of said push-button to engage and displace the plunger of said switch unit.

2. A momentary push-button switch assembly, comprising: a circuit board mounted in a first housing element defining a cavity, a switch unit mounted in a central region of said circuit board and an indicator lamp mounted on said circuit board adjacent said switch unit, said switch unit having a plunger displaceable to alter an electrical state of said switch unit;

a push-button retained in relation to said switch unit and said indicator lamp by a second housing element defining a closure for said cavity, the push-button having a contact area disposed in axial alignment with the plunger of said switch unit, and a light transmissive passage disposed in substantial axial alignment with said indicator lamp; and a unitary interface element mounted on said circuit board disposed intermediate said circuit board and said push-button, said interface element including a sleeve for locating said indicator lamp in relation to the light transmissive passage of said push-button, and cantilever means in resilient engagement with the contact area of said push-button, said cantilever means being deflectable upon depression of said push-button to engage and displace the plunger of said switch unit.

3. A momentary push-button switch assembly, comprising: a circuit board, a switch unit mounted on said circuit board adjacent said switch unit, said switch unit having a plunger displaceable to alter an electrical state of said switch unit;

a push-button having a contact area disposed in axial alignment with the plunger of said switch unit, and a light transmissive passage disposed in substantial axial alignment with said indicator lamp; and a unitary interface element disposed intermediate said circuit board and said push-button, said interface element including a sleeve for locating said indicator lamp in relation to the light transmissive passage of said push-button, and cantilever means in resilient engagement with the contact area of said push-button, said cantilever means being deflectable upon depression of said push-button to engage and displace the plunger of said switch unit, the cantilever means including first and second arms extending substantially in parallel from a base portion of said interface element, said arms being joined in proximity to said switch unit to define a first surface feature for continuous engagement with the contact area of said push-button and a second surface feature adapted to engage and displace said plunger during depression of said push-button.

* * * * *